US011830405B2

(12) United States Patent
Lee et al.

(10) Patent No.: US 11,830,405 B2
(45) Date of Patent: Nov. 28, 2023

(54) DISPLAY DEVICE

(71) Applicant: Samsung Display Co., LTD., Yongin-si (KR)

(72) Inventors: Jae Hoon Lee, Yongin-si (KR); Kyung Sik Joo, Yongin-si (KR); Sang Myeon Han, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/719,289

(22) Filed: Apr. 12, 2022

(65) Prior Publication Data

US 2023/0030225 A1 Feb. 2, 2023

(30) Foreign Application Priority Data

Jul. 26, 2021 (KR) ..... 10-2021-0098156

(51) Int. Cl.
*G09G 3/20* (2006.01)

(52) U.S. Cl.
CPC ... *G09G 3/2007* (2013.01); *G09G 2320/0233* (2013.01); *G09G 2320/041* (2013.01); *G09G 2320/045* (2013.01); *G09G 2360/16* (2013.01)

(58) Field of Classification Search
CPC ... G09G 2320/0233; G09G 2320/0285; G09G 2320/041; G09G 2320/045; G09G 2360/16; G09G 3/006; G09G 3/2007; G09G 3/3258; G09G 3/3426
See application file for complete search history.

(56) References Cited

U.S. PATENT DOCUMENTS

| | | | | |
|---|---|---|---|---|
| 10,262,582 | B2 | 4/2019 | Han | |
| 10,971,065 | B2 | 4/2021 | Hong et al. | |
| 11,056,053 | B2 | 7/2021 | Lee et al. | |
| 2010/0045709 | A1* | 2/2010 | Nakamura | G09G 3/3233 345/690 |
| 2010/0103083 | A1* | 4/2010 | Shin | G09G 3/3208 345/76 |
| 2017/0213493 | A1* | 7/2017 | Han | G09G 3/3208 |
| 2018/0151117 | A1* | 5/2018 | Choi | G09G 3/3225 |
| 2018/0247588 | A1* | 8/2018 | Lee | G09G 3/3225 |
| 2020/0058251 | A1* | 2/2020 | Lee | G09G 3/3607 |
| 2020/0111455 | A1* | 4/2020 | Lee | G09G 3/2007 |
| 2021/0065623 | A1* | 3/2021 | Hong | G09G 3/3266 |

FOREIGN PATENT DOCUMENTS

| | | |
|---|---|---|
| KR | 10-2017-0088452 | 8/2017 |
| KR | 10-2020-0021012 | 2/2020 |

* cited by examiner

*Primary Examiner* — Kenneth Bukowski
(74) *Attorney, Agent, or Firm* — H.C. Park & Associates, PLC

(57) ABSTRACT

A display device includes: a display panel including a plurality of pixels; a deterioration compensator that outputs compensation data based on a lifetime value of the plurality of pixels and an input grayscale of input image data; a scan driver that supplies a scan signal to the display panel; and a data driver that supplies a data signal corresponding to the compensation data to the display panel. The deterioration compensator includes a grayscale-current converter that calculates an input current corresponding to the input grayscale.

18 Claims, 9 Drawing Sheets

LUT1

IGR

| | 0 | 1 | 2 | 3 | ··· | G0 | ··· | 255 |
|---|---|---|---|---|---|---|---|---|
| 0 | A0 | B0 | C0 | D0 | ··· | G0 | ··· | E0 |
| 1 | A1 | B1 | C1 | D1 | ··· | G1 | ··· | E1 |
| 2 | A2 | B2 | C2 | D2 | ··· | G2 | ··· | E2 |
| 3 | A3 | B3 | C3 | D3 | ··· | G3 | ··· | E3 |
| ⋮ | ⋮ | ⋮ | ⋮ | ⋮ | ··· | ⋮ | ··· | ⋮ |
| 30 | A30 | B30 | C30 | D30 | ··· | G30 | ··· | E30 |
| ⋮ | ⋮ | ⋮ | ⋮ | ⋮ | ··· | ⋮ | ··· | ⋮ |
| 1023 | A1023 | B1023 | C1023 | D1023 | ··· | G1023 | ··· | E1023 |

AGE

CGR

LUT2_1

| Vdata (V) | Ids (mA) |
|---|---|
| ⋮ | ⋮ |
| 4 | 80 |
| 5 | 100 |
| 6 | 120 |

LUT2_2

GR

| BL | 0 | ··· | 31 | ··· | 127 | ··· | 255 |
|---|---|---|---|---|---|---|---|
| BL11 | VA1 | ··· | VB1 | ··· | VG1 | ··· | VE1 |
| BL12 | VA2 | ··· | VB2 | ··· | VG2 | ··· | VE2 |
| BL13 | VA3 | ··· | VB3 | ··· | VG3(4[V]) | ··· | VE3 |
| BL21 | VA4 | ··· | VB4 | ··· | VG4 | ··· | VE4 |
| BL22 | VA5 | ··· | VB5 | ··· | VG5(5[V]) | ··· | VE5 |
| BL23 | VA6 | ··· | VB6 | ··· | VG6 | ··· | VE6 |
| BL31 | VA7 | ··· | VB7 | ··· | VG7(6[V]) | ··· | VE7 |
| BL32 | VA8 | ··· | VB8 | ··· | VG8 | ··· | VE8 |
| BL33 | VA9 | ··· | VB9 | ··· | VG9 | ··· | VE9 |

Vdata

LUT2

| | GR | | | | | | |
|---|---|---|---|---|---|---|---|
| | 0 | ··· | 31 | ··· | 127 | ··· | 255 |
| BL11 | IA1 | ··· | IB1 | ··· | IG1 | ··· | IE1 |
| BL12 | IA2 | ··· | IB2 | ··· | IG2 | ··· | IE2 |
| BL13 | IA3 | ··· | IB3 | ··· | IG3(80[mA]) | ··· | IE3 |
| BL21 | IA4 | ··· | IB4 | ··· | IG4 | ··· | IE4 |
| BL22 | IA5 | ··· | IB5 | ··· | IG5(100[mA]) | ··· | IE5 |
| BL23 | IA6 | ··· | IB6 | ··· | IG6 | ··· | IE6 |
| BL31 | IA7 | ··· | IB7 | ··· | IG7(120[mA]) | ··· | IE7 |
| BL32 | IA8 | ··· | IB8 | ··· | IG8 | ··· | IE8 |
| BL33 | IA9 | ··· | IB9 | ··· | IG9 | ··· | IE9 |

BL

Iin

LUT3(grayscale: 127, thirty-first block(BL31))

| Pixel | Spot compensating grayscale | Input current |
|---|---|---|
| PX1 | 115 | 116 |
| PX2 | 127 | 120 |
| PX3 | 130 | 128 |
| PX4 | 129 | 124 |

DISPLAY DEVICE

CROSS-REFERENCE TO RELATED APPLICATION

This application claims priority from and the benefit of Korean Patent Application No. 10-2021-0098156, filed on, Jul. 26, 2021, which is hereby incorporated by reference for all purposes as if fully set forth herein.

BACKGROUND

Field

Embodiments of the invention relate generally to a display device.

Discussion of the Background

As information technology has developed, the importance of a display device has become important as a connection medium between a user and information. Accordingly, the use of display devices such as liquid crystal display devices, organic light emitting display devices, and the like has been increasing.

A display device may include pixels, and each of the pixels may include a light emitting element and a transistor driving the light emitting element. A plurality of pixels may include pixel circuits having substantially the same structure. However, a process deviation between pixels may occur due to a low-temperature polysilicon process, a deposition process, or the like. Accordingly, in a display device, a luminance deviation may occur for each pixel, which is undesirable unless compensated for in an appropriate manner.

Therefore, during a manufacturing process of the display device, the luminance deviation may be compensated through a process of measuring luminance of the display device (or an image displayed through the display device) and adjusting a voltage applied to the display device (or adjusting an offset or compensation value for emission characteristics of each of the pixels).

In the case of compensating for the luminance deviation, an input current may be changed for each pixel (or for each position of the display panel) in response thereto. A degree of deterioration of the pixel may vary according to an amount of the input current.

The above information disclosed in this Background section is only for understanding of the background of the inventive concepts, and, therefore, it may contain information that does not constitute prior art.

SUMMARY

Display devices constructed according to illustrative implementations of the invention are capable of precisely perform afterimage compensation.

Inventive concepts consistent with at least one embodiment of the present invention has been made in an effort to provide a display device that may more precisely perform afterimage compensation by assigning a weight according to an amount of input current for each position of a display panel after gamma correction and optical compensation.

Additional features of the inventive concepts will be set forth in the description that follows, and in part will be apparent from the description, or may be learned by practice of the inventive concepts.

An embodiment provides a display device that includes: a display panel that includes a plurality of pixels; a deterioration compensator that is configured to output compensation data based on a lifetime value of the plurality of pixels and an input grayscale of input image data; a scan driver that is configured to supply a scan signal to the display panel; and a data driver that is configured to supply a data signal corresponding to the compensation data to the display panel.

The deterioration compensator includes a grayscale-current converter that is configured to calculate an input current corresponding to the input grayscale.

The deterioration compensator may include a deterioration information generator that is configured to calculate a deterioration weight value for each position of the pixels based on the input current and a preset reference current, and that is configured to update the lifetime value by accumulating deterioration data reflecting the deterioration weight value.

The deterioration weight value may be calculated by Equation 1 below.

$$Wp=(I_{in}/I_{ref})^{\alpha} \quad \text{[Equation 1]}$$

Here, Wp is a deterioration weight value, Iref is a reference current, Iin is an input current, and $\alpha$ is a current acceleration coefficient.

The deterioration compensator may include a compensator that is configured to calculate a compensation grayscale by using the input grayscale and the lifetime value.

The compensator may include a first lookup table in which a plurality of lifetime values and compensation grayscales respectively corresponding to grayscales that are able to be implemented by the display panel are set; and the compensation grayscale may be determined by a value which is mapped to the input grayscale and the lifetime value in the first lookup table.

The grayscale-current converter may include a second lookup table in which the compensation grayscales and input currents corresponding to respective blocks partitioned in the display panel are set after gamma correction; and the input current may be determined by a value which is mapped to the compensation grayscale and the blocks in the second lookup table.

The second lookup table may be calculated by using a (2_1)-th lookup table including information on a plurality of test voltages and corresponding driving currents measured in one reference pixel among the plurality of pixels after external compensation; and a (2_2)-th lookup table including information on a plurality of grayscales and corresponding data voltages for each block after the gamma correction.

The grayscale-current converter may include a second lookup table in which the compensation grayscales and input currents corresponding to respective blocks partitioned in the display panel are set after gamma correction; and a third lookup table in which the compensation grayscales and input currents corresponding to respective pixels in which a spot occurs are set after spot compensation, and the input current may be determined by a value which is mapped to the compensation grayscale and the blocks in the third lookup table.

The deterioration compensator may further includes an output part that is configured to generate the compensation data by applying the compensation grayscale to the input image data.

The pixels may be grouped into a plurality of blocks, and the number of the blocks may be smaller than or equal to a number of the pixels.

The display device may further include a temperature sensor that is configured to measure an ambient temperature) of the display panel.

The deterioration information generator may accumulate the deterioration data by reflecting input grayscales for the pixels and a temperature acceleration value corresponding to the ambient temperature to the deterioration data.

The deterioration information generator may calculate the deterioration data by multiplying a grayscale acceleration value corresponding to the input grayscale, the temperature acceleration value, and the deterioration weight value.

The deterioration information generator may accumulate the deterioration data by further reflecting a grayscale acceleration value of a current may calculated by Equation 2 below to the deterioration data.

$$GRV[n]=(G_i/G_{max})^{\beta\gamma} \quad \text{[Equation 2]}$$

Here, GRV[n] is a grayscale acceleration value in the current image frame, Gi is an input grayscale, Gmax is a maximum grayscale, β is a luminance acceleration coefficient, and γ is a gamma value.

The display device may further include a memory storing the lifetime value.

According to the display device of the embodiment, by assigning a weight according to an amount of input current for each position of a display panel by using a grayscale-current relationship obtained through gamma correction and optical compensation, it is possible to more precisely perform afterimage compensation.

It is to be understood that both the foregoing general description and the following detailed description are illustrative and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate illustrative embodiments of the invention, and together with the description serve to explain the inventive concepts.

DETAILED DESCRIPTION

Figure 1:
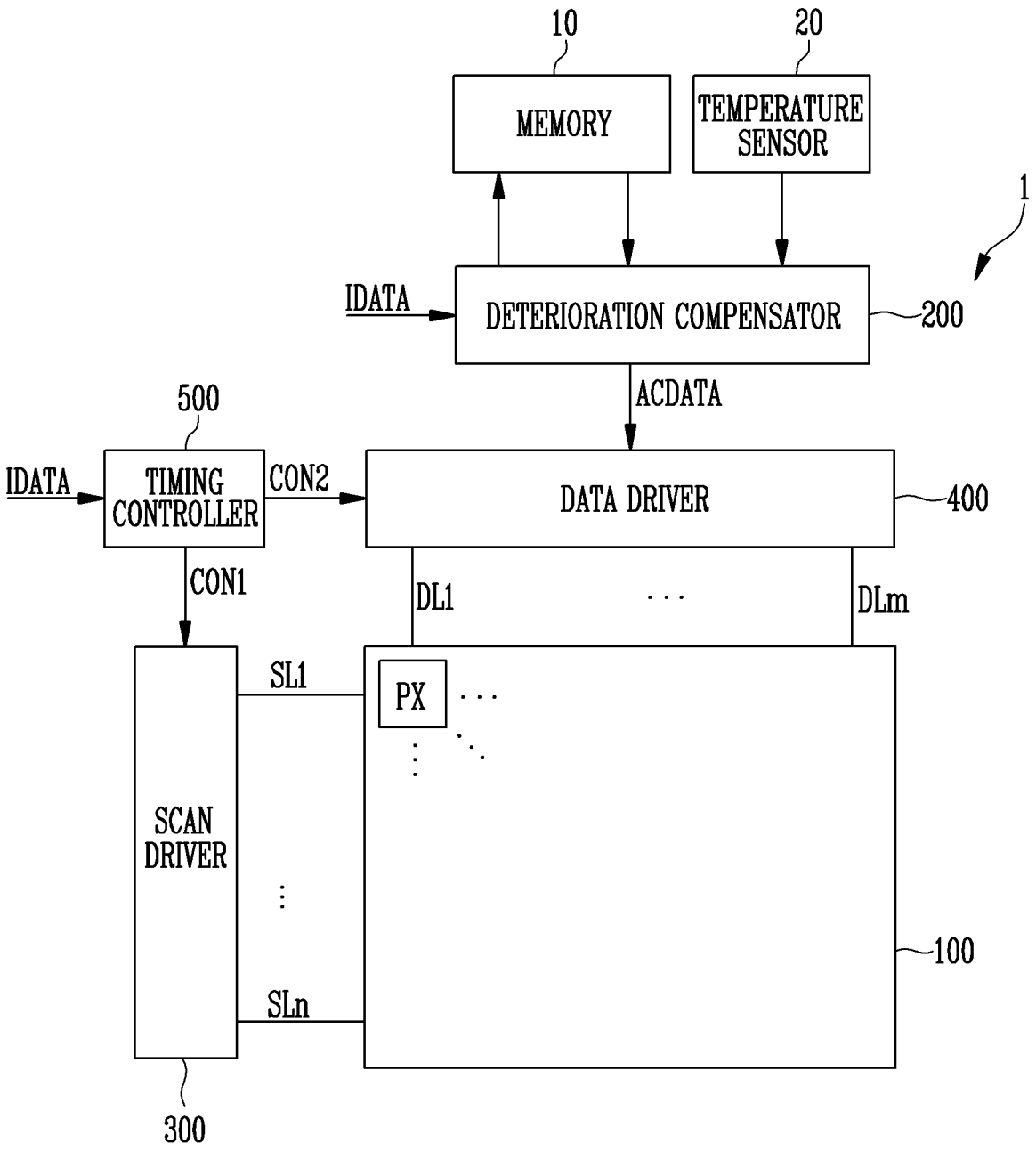
FIG. 1 illustrates a configuration of a display device according to an embodiment that is constructed according to principles of the invention.

In the following description, for the purposes of explanation, numerous specific details are set forth in order to provide a thorough understanding of various embodiments or implementations of the invention. As used herein "embodiments" and "implementations" are interchangeable words that are non-limiting examples of devices or methods employing one or more of the inventive concepts disclosed herein. It is apparent, however, that various embodiments may be practiced without these specific details or with one or more equivalent arrangements. In other instances, well-known structures and devices are shown in block diagram form in order to avoid unnecessarily obscuring various embodiments. Further, various embodiments may be different, but do not have to be exclusive. For example, specific shapes, configurations, and characteristics of an embodiment may be used or implemented in another embodiment without departing from the inventive concepts.

Unless otherwise specified, the illustrated embodiments are to be understood as providing illustrative features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As customary in the field, some embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some embodiments may be physically separated into two or more interacting and discrete blocks, units, and/or modules without departing from the scope of the inventive concepts. Further, the blocks, units, and/or modules of some embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Hereinafter, various embodiments will be described in detail with reference to the accompanying drawings.

FIG. 1 illustrates a configuration of a display device according to an embodiment that is constructed according to principles of the invention. FIG. 2 is a drawing for explaining a display panel according to an embodiment.

Referring to FIG. 1, a display device 1 according to an embodiment may include a display panel 100, a deterioration compensator 200, a scan driver 300, a data driver 400, a timing controller 500, a memory 10, and a temperature sensor 20.

The display device 1 may include an organic light emitting display device, an inorganic light emitting display device, and a liquid crystal display. In addition, the display device 1 may include a flexible display device, a rollable display device, a curved display device, a transparent display device, and a mirror display device that are implemented with the organic light emitting display device and the like.

The display panel 100 may include a plurality of pixels PX, and may display an image. Specifically, the display panel 100 may include a pixel PX that is connected to at least one of a plurality of scan lines SL1 to SLn and at least one of a plurality of data lines DL1 to DLm.

The display panel 100 may provide deterioration data of the pixels PX to the deterioration compensator 200. The deterioration data may be calculated based on a current, a grayscale, a temperature, and the like of the pixels PX. The deterioration data may be generated in units of blocks including individual pixels PX or grouped pixels PX.

Figure 2A:
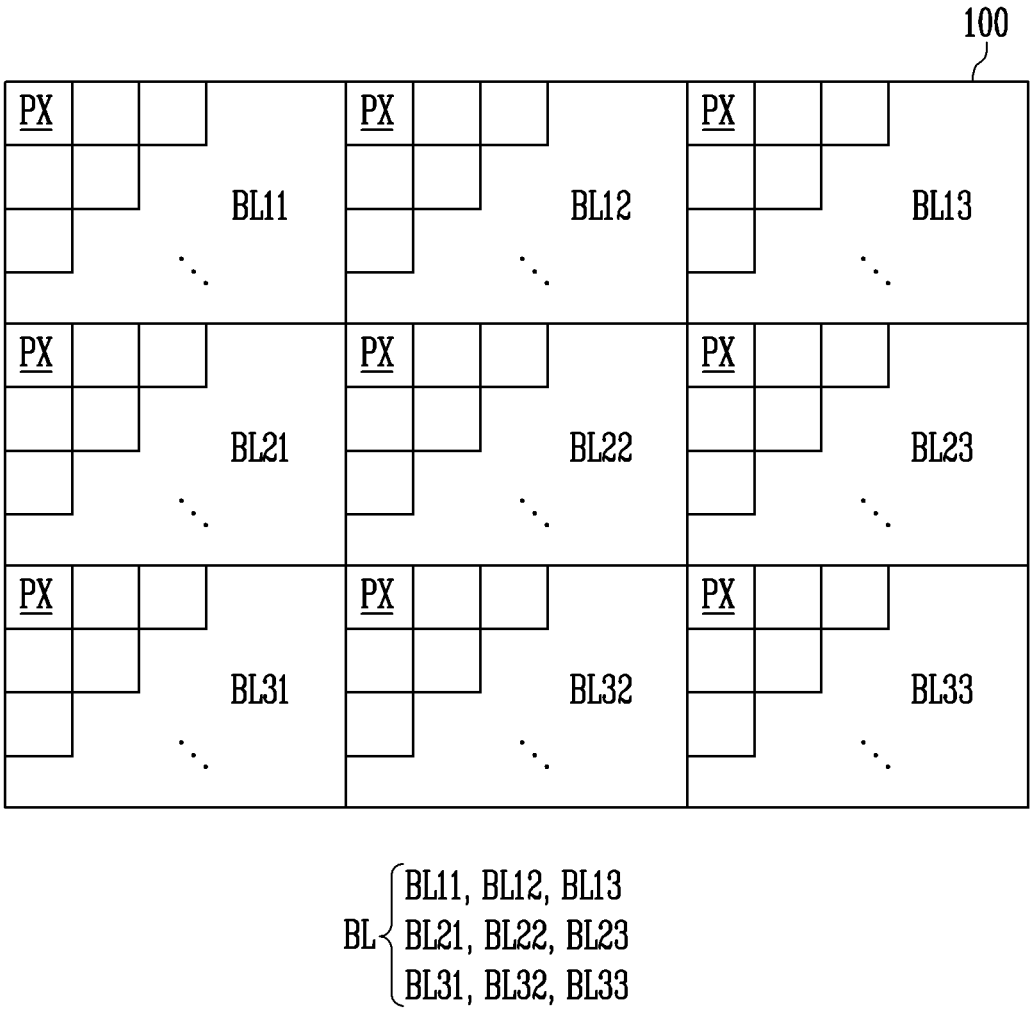
FIG. 2A is a drawing for explaining a display panel according to an embodiment.

As shown in FIG. 2A, the pixels PX included in the display panel 100 may be partitioned into a plurality of blocks BL11, BL12, BL13, BL21, BL22, BL23, BL31, BL32, and BL33. For example, each of the blocks BL11, BL12, BL13, BL21, BL22, BL23, BL31, BL32, and BL33 may include the same number of pixels PX, and the blocks BL11, BL12, BL13, BL21, BL22, BL23, BL31, BL32, and BL33 may not overlap each other. In another embodiment, the blocks BL11, BL12, BL13, BL21, BL22, BL23, BL31, BL32, and BL33 may include a different number of pixels PX. In another embodiment, the blocks BL11, BL12, BL13, BL21, BL22, BL23, BL31, BL32, and BL33 may share (that is, overlap) at least some pixels PX.

The block BL is a virtual element defining a control unit for a plurality of pixels PX, and is not a physical constituent element. The block BL may be written and defined in a memory before product shipment, or may be actively redefined during product use.

FIG. 2A illustrates the blocks BL11, BL12, BL13, BL21, BL22, BL23, BL31, BL32, and BL33 divided into 3 rows and 3 columns for better understanding and ease of description, but the number of blocks BL is not limited thereto, and it may be variously changed according to a size and specification of the display panel 100.

Referring back to FIG. 1, the deterioration compensator 200 may calculate compensation data ACDATA based on an input grayscale included in input image data IDATA provided from the outside. Specifically, the deterioration compensator 200 may calculate a deterioration weight for each position of the pixels PX based on an input current calculated from a grayscale-current converter 230 (refer to FIG. 5) to be described later and a preset reference current value, may update a lifetime value by accumulating deterioration data reflecting the deterioration weight, and may calculate a compensation grayscale by reflecting the updated lifetime value in the input grayscale of the input image data IDATA. The deterioration compensator 200 may generate the compensation data ACDATA by applying the calculated compensation grayscale to the input image data IDATA.

In this case, the input current is not actually measured, but may be calculated through an algorithm according to an embodiment based on information obtained through gamma correction and/or optical compensation performed on the display device 1 before product shipment. The process in which the grayscale-current converter 230 calculates the input current through the algorithm will be described in detail later in FIG. 5 to FIG. 9B.

When the deterioration compensator 200 receives an ambient temperature from the temperature sensor 20, the deterioration compensator 200 may calculate deterioration data by using the input grayscale and ambient temperature for the pixels PX. The temperature sensor 20 may measure an ambient temperature of the display device 1. Specifically, the temperature sensor 20 may measure the ambient temperature of the display panel 100, and may provide information on the measured ambient temperature to the deterioration compensator 200. In the embodiment, when the pixels PX are partitioned into the block BL (see FIG. 2A), the temperature sensor 20 may measure the ambient temperature in units of blocks BL.

The deterioration compensator 200 may update the lifetime value by adding the calculated deterioration data to an existing lifetime value, and may calculate the compensation grayscale by reflecting the updated lifetime value in the input grayscale.

Although the deterioration compensator 200 is illustrated as a separate configuration in FIG. 1, the deterioration compensator 200 may be included in the timing controller 500 in some cases. Alternatively, the deterioration compensator 200 may be included in the data driver 400.

The accumulated lifetime data may be stored in the external memory 10, and the memory 10 may be a flash memory.

The scan driver 300 may provide a scan signal to the pixels PX of the display panel 100 through the scan lines SL1 to SLn. The scan driver 300 may provide a scan signal to the display panel 100 based on a first control signal CON1 received from the timing controller 500.

The data driver 400 may provide a data signal corresponding to the compensation data ACDATA to the pixels PX of the display panel 100 through the data lines DL1 to DLm. The data driver 400 may provide a data signal to the display panel 100 based on a second control signal CON2 received from the timing controller 500.

The data driver 400 may include a gamma voltage generator that converts the compensation data ACDATA into a voltage corresponding to the data signal. The compensation data ACDATA in a grayscale domain may be converted into a data voltage in a voltage domain by the gamma voltage generator. According to the embodiment, the gamma voltage generator may be disposed separately from the data driver 400.

The timing controller 500 receives input image data IDATA from an external graphic source and the like, generates the first and second control signals CON1 and CON2, and provides the first and second control signals CON1 and CON2 to the scan driver 300 and the data driver 400, thereby controlling driving of the scan driver 300 and the data driver 400. In this case, the input image data IDATA may include input grayscale data, and the timing controller 500 may further control driving of the deterioration compensator 200.

Figure 2B:
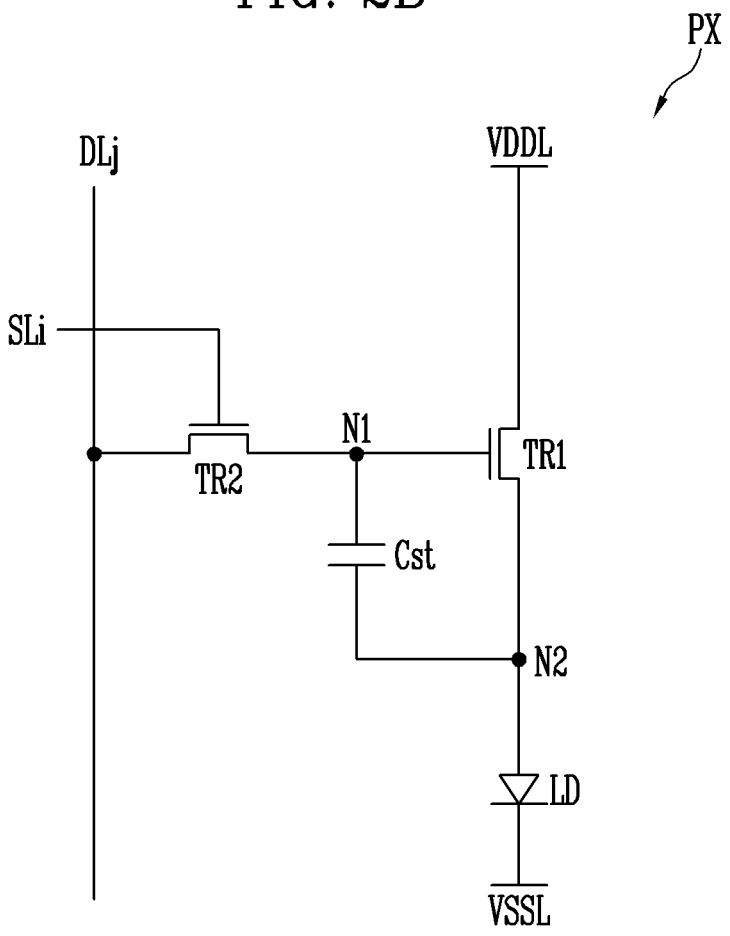
FIG. 2B illustrates a circuit diagram of an example of a pixel included in the display device of FIG. 1.

FIG. 2B illustrates a circuit diagram of an example of a pixel included in the display device of FIG. 1. In FIG. 2B, for better understanding and ease of description, a pixel PX disposed in an i-th row and a j-th column will be mainly described.

Referring to FIG. 2B, the pixel PX may include first and second transistors TR1 and TR2, a storage capacitor Cst, and a light emitting element LD.

Hereinafter, a circuit configured of an N-type of transistor will be described as an example. However, those skilled in the art will be able to design a circuit configured of a P-type of transistor by varying a polarity of a voltage applied to a gate terminal. Similarly, a person of an ordinary skill in the art would be able to design a circuit configured of a combination of a P-type of transistor and an N-type of transistor. The P-type of transistor refers to a transistor in which an amount of current that is conducted when a voltage difference between a gate terminal and a source terminal increases in a negative direction increases. The N-type of transistor refers to a transistor in which an amount of current that is conducted when a voltage difference between a gate terminal and a source terminal increases in a positive direction increases. The transistor may have various kinds such as a thin film transistor (TFT), a field effect transistor (FET), and a bipolar junction transistor (BJT).

The first transistor TR1 may be connected between a first power line VDDL and the light emitting element (LD) (or a second node N2), and a gate electrode thereof may be connected to a first node N1. The first transistor TR1 may control an amount of current flowing from the first power line VDDL to a second power line VSSL via the light emitting element LD in response to a voltage of the first node N1. The first transistor TR1 may be referred to as a driving transistor.

The second transistor TR2 may be connected between a data line DLj and the first node N1, and a gate electrode thereof may be connected to a scan line SLi. The second transistor TR2 is turned on when a scan signal is supplied to the scan line SLi, so that the data line DLj and the first node N1 may be electrically connected. Accordingly, the data signal may be transmitted to the first node N1. The second transistor TR2 may be referred to as a scan transistor.

The storage capacitor Cst may be connected between the first node N1 corresponding to the gate electrode of the first transistor TR1 and a second electrode of the first transistor TR1. The storage capacitor Cst may store a voltage corresponding to a voltage difference between the gate electrode and the second electrode of the first transistor TR1.

A first electrode (anode or cathode electrode) of the light emitting element LD may be connected to the second electrode (or second node N2) of the first transistor TR1, and a second electrode (cathode or anode electrode) of the light emitting element LD may be connected to the second power line VSSL. The light emitting element LD may generate light of a predetermined luminance in response to an amount of current (an input current) supplied from the first transistor TR1.

The light emitting element LD may be selected as an organic light emitting diode. In addition, the light emitting element LD may be selected as an inorganic light emitting diode such as a micro light emitting diode (LED) or a quantum dot light emitting diode. Further, the light emitting element LD may be an element complexly made of organic and inorganic materials. In FIG. 2B, it is illustrated that the pixel PX includes a single light emitting element LD, but in another embodiment, the pixel PX may include a plurality of light emitting elements LD, and the plurality of light emitting elements LD may be connected in series, in parallel, or in series/parallel to each other.

A voltage of the first power source may be applied to the first power line VDDL, and a voltage of the second power source may be applied to the second power line VSSL. For example, the voltage of the first power source may be larger than the voltage of the second power source.

When a scan signal having a turn-on level (here, a logic high level) is applied through the scan line SLi, the second transistor T2 is turned on. In this case, a voltage corresponding to the data signal applied to the data line DLj may be stored in the first node N1 (or a first electrode of the storage capacitor Cst).

A driving current, which corresponds to a voltage difference between the first electrode and the second electrode of the storage capacitor Cst, flows between the first electrode and the second electrode of the first transistor T1. Accordingly, the light emitting element LD may emit light with luminance corresponding to the data signal.

Figures 3, 4:
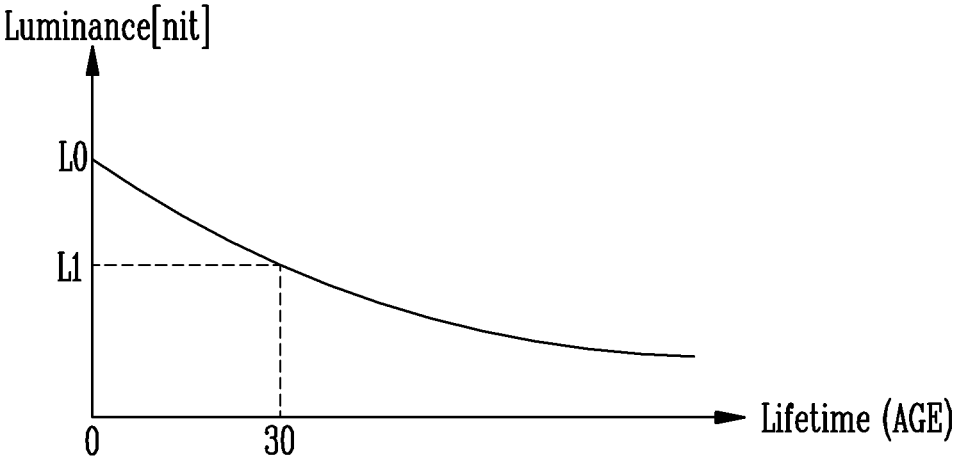
FIG. 3 and FIG. 4 are drawings for schematically explaining a method for determining a compensation grayscale corresponding to a lifetime of a pixel.

FIG. 3 and FIG. 4 are drawings for schematically explaining a method for determining a compensation grayscale corresponding to a lifetime of a pixel. Here, FIG. 3 illustrates a graph corresponding to a lifetime-luminance function of a pixel. FIG. 4 exemplarily illustrates a first lookup table including compensation amount information corresponding to a lifetime and a grayscale of a pixel.

Referring to FIG. 1 to FIG. 4, the graph shown in FIG. 3 may be a lifetime (AGE)-luminance function of the pixel PX calculated when an input grayscale IGR is a first grayscale G0, and in another input grayscale IGR, a graph corresponding to a lifetime luminance function of the pixel PX may be different from that shown in FIG. 3.

Referring to FIG. 3, when the input grayscale IGR corresponding to the first grayscale G0 is inputted at an initial time (that is, AGE=0), the pixel may emit light with a first luminance L0. However, when the deterioration of the pixel PX proceeds (for example, when it is being changed from AGE=0 to AGE=30), and when the input grayscale IGR corresponding to the first grayscale G0 is inputted, the pixel PX may emit light with a second luminance L1 that is darker than the first luminance L0. In this case, in order to calculate the lifetime AGE more accurately, a current, a grayscale, a temperature, and the like for each position of the display panel 100 may be reflected.

The deterioration compensator 200 according to the embodiment described herein may compensate the input grayscale IGR with a grayscale having a higher value than the first grayscale G0 so that the pixel PX may emit light with the first luminance L0 corresponding to the first grayscale G0. In this case, the compensated grayscale information may be determined with reference to a first lookup table LUT1 as shown in FIG. 4.

As shown in FIG. 4, a plurality of lifetime values AGE and compensation grayscales CGR corresponding to each of display grayscales (or input grayscales IGR) that may be implemented by the display panel 100 may be set in the first lookup table LUT1. When a case in which the compensation grayscale CGR is generated by using the first lookup table LUT1 is described as an example, and when the input grayscale IGR is the first grayscale G0 and the lifetime value AGE of the pixel is 30, the compensation grayscale CGR may be a second grayscale G30 that is higher than the first grayscale G0.

That is, the deterioration compensator 200 controls a current corresponding to the second grayscale G30 to flow through the light emitting element LD included in the deteriorated pixel PX so that the lifetime value AGE becomes 30, so that the pixel PX may emit light with the first luminance L0 corresponding to the first grayscale G0.

Figure 5:
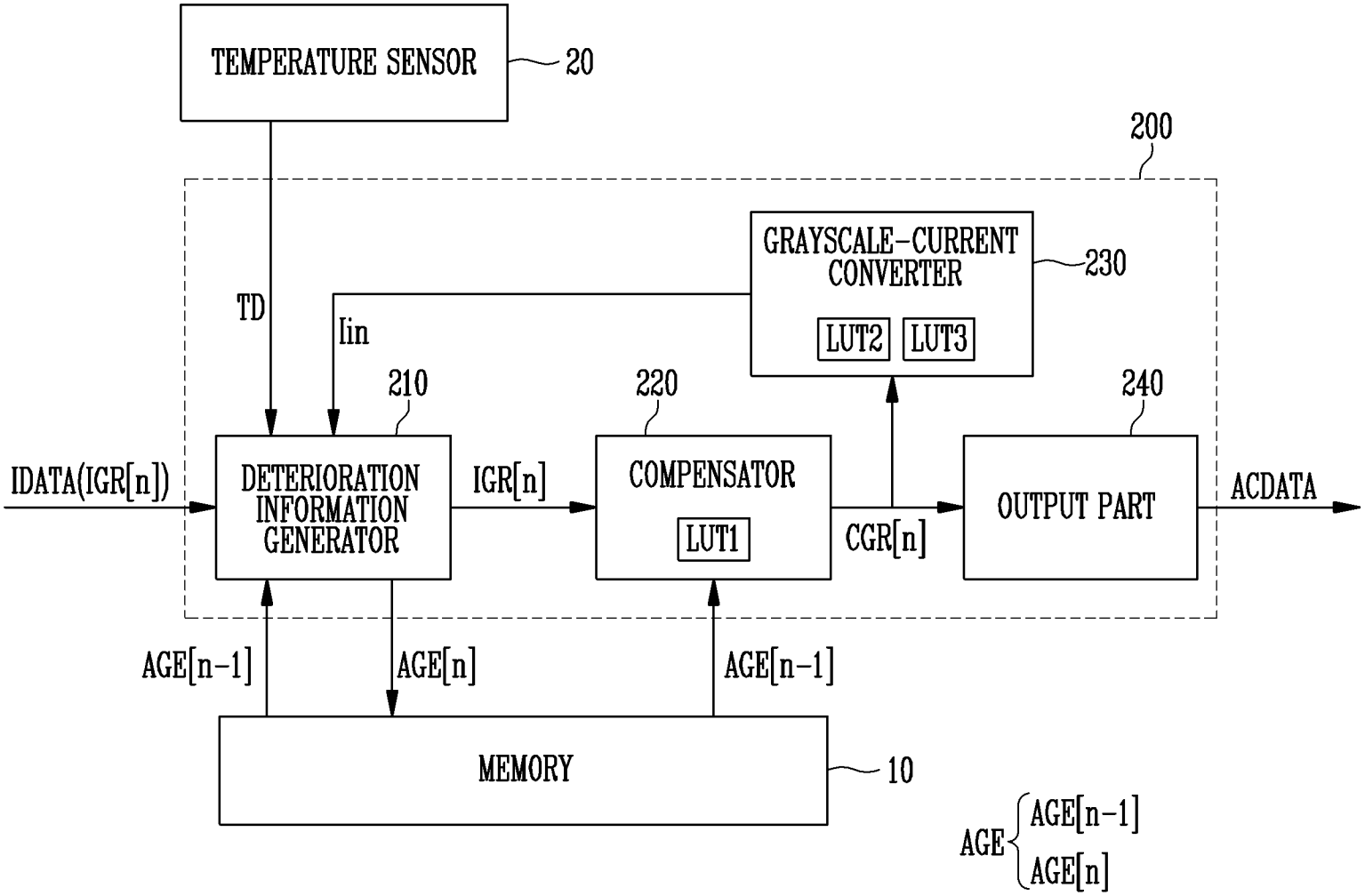
FIG. 5 illustrates a block diagram for explaining an operation of a deterioration compensator shown in FIG. 1.
Figures 6A, 6B:
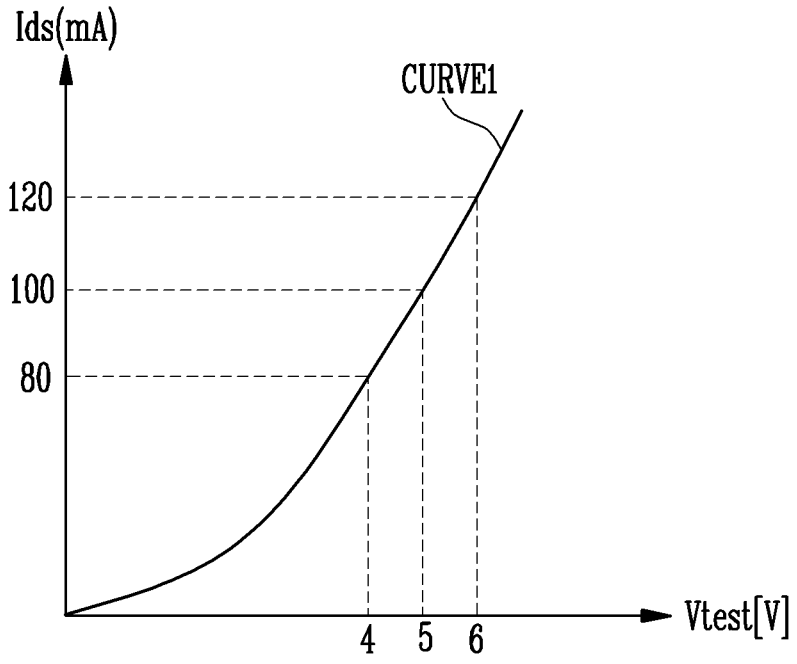
FIG. 6A and FIG. 6B are drawings for explaining a method of determining a driving current corresponding to a test voltage applied to a pixel.
Figures 7A, 7B:
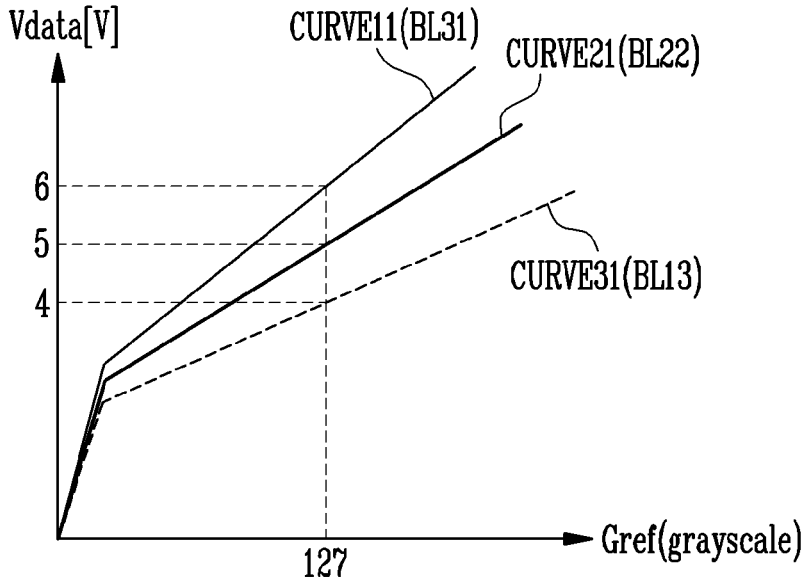
FIG. 7A and FIG. 7B are drawings for explaining a method of determining a data voltage (or gamma voltage) for each block corresponding to a reference grayscale after gamma correction.
Figures 8A, 8B:
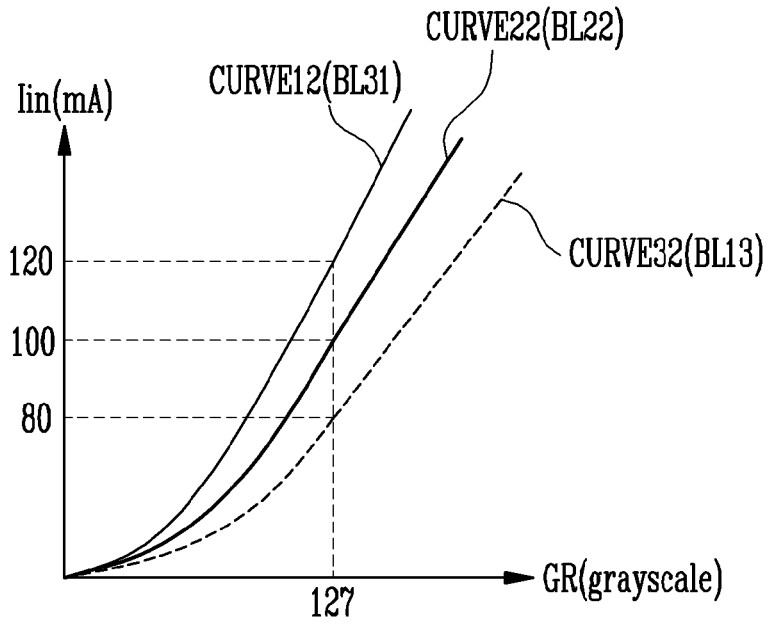
FIG. 8A and FIG. 8B are drawings for explaining a method of determining an input current for each block corresponding to a reference grayscale after gamma correction.
Figures 9A, 9B:
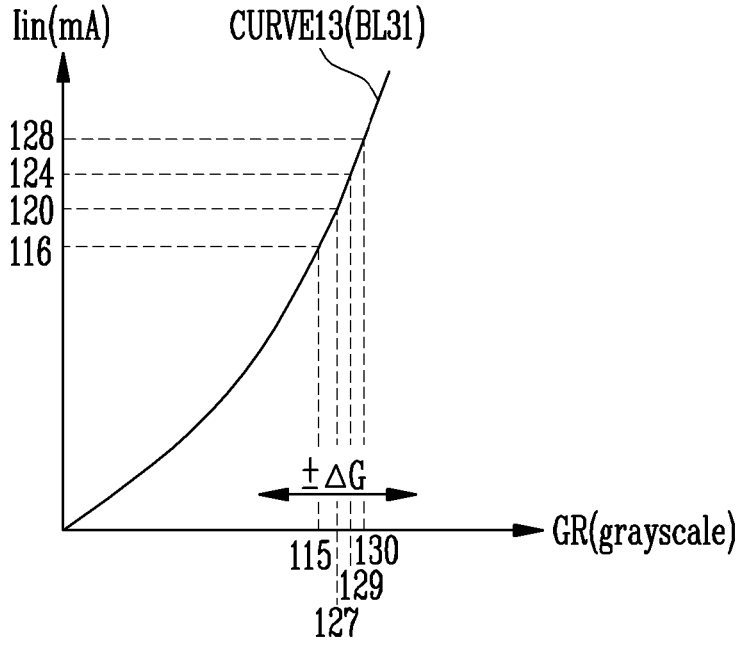
FIG. 9A and FIG. 9B are drawings for explaining a method of determining an input current corresponding to a reference grayscale after optical compensation (or spot correction).

FIG. 5 illustrates a block diagram for explaining an operation of a deterioration compensator shown in FIG. 1. FIG. 6A and FIG. 6B are drawings for explaining a method of determining a driving current corresponding to a test voltage applied to a pixel. FIG. 7A and FIG. 7B are drawings for explaining a method of determining a data voltage (or gamma voltage) for each block corresponding to a reference grayscale after gamma correction. FIG. 8A and FIG. 8B are drawings for explaining a method of determining an input current for each block corresponding to a reference grayscale after gamma correction. FIG. 9A and FIG. 9B are drawings for explaining a method of determining an input current corresponding to a reference grayscale after optical compensation (or spot correction).

Referring to FIG. 1, FIG. 2A, and FIG. 5, the deterioration compensator 200 may include a deterioration information generator 210, a compensator 220, a grayscale-current converter 230, and an output part 240.

The deterioration compensator 200 may calculate a compensation grayscale CGR[n] by using input image data IDATA provided from outside, temperature data TD provided from the temperature sensor 20, and lifetime values AGE[n−1] and AGE[n] loaded from the memory 10, and may output the compensation data ACDATA by applying the compensation grayscale CGR[n] to the input image data IDATA.

The deterioration information generator 210 may calculate a deterioration weight for each position (for example, the pixel PX and/or block BL) of the display panel 100 based on an input current Iin provided from the grayscale-current converter 230 and a preset reference current value, and may update lifetime value AGE by accumulating the deterioration data to which the deterioration weight is reflected. The deterioration information generator 210 may calculate the deterioration weight value based on a ratio of the input current Iin to the reference current value. Specifically, the deterioration weight value may be calculated by the equation below.

$$Wp=(I_{in}/I_{ref})^{\alpha}Wp=(I_{in}/I_{ref})^{\alpha}$$

(Here, Wp is a deterioration weight value, Iref is a reference current, Iin is an input current, and a is a current acceleration coefficient. The current acceleration coefficient may be pre-stored in the memory 10 before shipment, and may be actively re-defined during product use.)

The reference current value may connote a current value expected when reference grayscale data is inputted from the outside at a reference temperature, may be pre-stored in the memory 10 before shipment, and may be actively re-defined in the process of using the product.

In addition, the deterioration weight value may connote a parameter reflecting a characteristic deviation for each position of a plurality of pixels PX. The deterioration weight value may be set as an initial value before shipment. A plurality of deterioration weight values may be set to correspond to each of the pixels PX. When a plurality of pixels PX are partitioned into the aforementioned blocks BL, the deterioration weight value may be set to correspond to each of the blocks BL, and in this case, the deterioration weight value corresponding to one specific block BL may be referred to as a block deterioration weight value.

In addition, the deterioration data may indicate a degree of deterioration of a specific pixel PX according to its size. When the aforementioned deterioration weight value and a predetermined grayscale value are inputted, grayscale acceleration according to the compensated and outputted grayscale and temperature acceleration according to an internal temperature of the display device 1 may be reflected in the deterioration data. As described above, a plurality of deterioration data may be set to correspond to each of the pixels PX, and a plurality of deterioration data may be set to correspond to each of the blocks including a certain number of pixels, and in this case, the deterioration data corresponding to one specific block BL may be referred to as block deterioration data.

In addition, the lifetime value AGE may connote an accumulated value of deterioration data, and may connote a value necessary to compensate for the inputted grayscale. Specifically, a lifetime value in a current image frame may be updated by adding deterioration data to a lifetime value AGE up to a previous image frame. As described above, a plurality of lifetime values AGE may also be set to correspond to each of the pixels PX, and may be set to correspond to each of the blocks BL, and in this case, the lifetime value AGE corresponding to one specific block BL may be referred to as a block lifetime value.

Hereinafter, before describing the remaining components of the deterioration information generator 210, the compensator 220, and the output part 240, the grayscale-current converter 230 that provides the input current Iin necessary to calculate the deterioration weight will first be described with reference to FIG. 5 to FIG. 9B.

The grayscale-current converter 230 may receive the compensation grayscale CGR[n], and may output the input current Iin corresponding to the compensation grayscale CGR[n]. However, before product shipment (that is, AGE=0), the compensation grayscale GGR[n] provided to the grayscale-current converter 230 may be substantially the same as the input grayscale IGR[n].

According to the embodiment, the grayscale-current converter 230 may include a second lookup table LUT2. According to another embodiment, the grayscale-current converter 230 may further include a third lookup table LUT3.

The grayscale-current converter 230 according to the embodiment described herein does not actually measure and obtain the current (that is, input current Iin) for each position of the display panel 100, but a current (that is, the input current Iin) for each position of the display panel 100 may be obtained by using the second lookup table LUT2 and/or the third lookup table LUT3 generated through an algorithm to be described later. In this case, the second lookup table LUT2 and the third lookup table LUT3 may include the input grayscale IGR[n] (or compensation grayscale CGR [n]), and corresponding input current Iin information for each position of the display panel 100.

The algorithm according to the embodiment described herein may calculate the input current Iin for each position of the display panel 100 corresponding to the input grayscale IGR[n] through three steps.

First, as a first step, a representative voltage-current characteristic of a reference pixel may be calculated. That is, after external compensation of the display panel 100, one reference pixel among the plurality of pixels PX is selected, a plurality of voltages are applied to the reference pixel, and then a current flowing through the reference pixel is measured correspondingly, so that the representative voltage-current characteristic graph of the pixel PX may be obtained.

For example, a first curved line CURVE1 illustrated in FIG. 6A is formed by selecting one pixel PX included in the 22nd block BL22 (refer to FIG. 2A) as a reference pixel, and it shows a characteristic of an input current Ids corresponding to a plurality of test voltages Vtest. In this case, the 22nd block BL22 (see FIG. 2A) corresponds to a central area of the display panel 100, and since a voltage-current characteristic of the pixel PX included in the central area is substantially better than that of an outer area of the display panel 100, it may be desirable that one pixel PX included in the central area of the display panel 100 is determined as a reference pixel.

Specifically, when the test voltages Vtest of 4 [V], 5 [V], and 6 [V] are applied to the gate electrode (or first node N1, see FIG. 2B) of the first transistor TR1 included in the reference pixel, the driving current Ids flowing through the first transistor T1 may be measured as 80 [mA], 100 [mA], and 120 [mA], respectively. The driving current Ids for a voltage between the test voltages Vtest may be obtained through interpolation. FIG. 6A illustrates three test voltages Vtest for better understanding and ease of description, but this is exemplary, and the test voltages Vtest may be variously changed according to a design. As the number of the test voltages Vtest increases, the first curved line CURVE1 may more accurately reflect the input current Ids characteristic according to the test voltages Vtest.

Referring to FIG. 6B, a (2_1)-th lookup table LUT2_1 may be created by using the representative voltage-current characteristic graph (that is, the first curved line CURVE1) shown in FIG. 6A. That is, the (2_1)-th lookup table LUT2_1 may include information about a plurality of test voltages Vtest and corresponding driving currents Ids measured in a specific area of the display panel 100 after external compensation.

Next, as a second step, the input current Iin for each position of the display panel 100 corresponding to the input grayscale IGR[n] (or the compensation grayscale CGR[n]) after gamma correction may be calculated. That is, after the gamma compensation of the display panel 100 is performed, the grayscale-voltage graph indicating data voltages (or gamma voltages) for each position of the display panel 100 corresponding to the reference grayscale may be calculated, and by using the grayscale-voltage graph and the representative voltage-current characteristic graph (or the (2_1)-th lookup table LUT2_1) obtained in the first step, the grayscale-current graph indicating the input current Iin for each position of the display panel 100 corresponding to the input grayscale IGR[n] may be calculated.

Referring to FIG. 7A, after the gamma correction, the display panel 100 may have different data voltages Vdata (or gamma voltages) (for example, 4 [V], 5 [V], and 6 [V]) for each block (for example, BL13, BL22, and BL31) with respect to the same reference grayscale Gref (for example, grayscale of 127) due to a process deviation. Here, an eleventh curved line CURVE11 represents a characteristic of the data voltage Vdata (or gamma voltage) after gamma correction of the thirty-first block BL31 according to the reference grayscale Gref. A twenty-first curved line CURVE21 represents a characteristic of the data voltage Vdata (or gamma voltage) after gamma correction of the twenty-second block BL22 according to the reference grayscale Gref. In addition, a thirty-first curved line CURVE31 represents a characteristic of the data voltage Vdata (or gamma voltage) after gamma correction of the thirteenth block BL13 according to the reference grayscale Gref. The reference grayscales Gref may correspond to some selected grayscales among a plurality of grayscales, and for example, the reference grayscales Gref may correspond to an inflection point in the gamma curved line. The reference grayscales may include a grayscale of 0, a grayscale of 31, a grayscale of 127, . . . , a grayscale of 255 among 256 grayscales.

FIG. 7A illustrates grayscale-voltage graphs only for the thirty-first block BL31, the twenty-second block BL22, and the thirteenth block BL13 for better understanding and ease of description, but as many as the number of the blocks BL included in the display panel 100, the grayscale-voltage graphs may be obtained. For example, as shown in FIG. 2A, when the display panel 100 is partitioned into the blocks BL of 3 rows and 3 columns, a total of 9 grayscale-voltage graphs may be obtained.

When a gamma correction process is described in more detail with reference to FIG. 7A and FIG. 7B, the display device 1 may perform gamma correction by using an optical compensation device before product shipment. The optical compensation device may include a luminance measuring part (or an image capturing part).

The optical compensation device may select a target luminance for each reference grayscale Gref, generate a data voltage Vdata corresponding to the target luminance, and provide the generated data voltage Vdata to the display panel 100.

Next, the optical compensation device may image the display panel 100 for each block BL through the luminance measuring part to obtain the measured luminance.

Next, the optical compensation device may compare the measured luminance with the target luminance, determine whether a difference between the measured luminance and the target luminance is within a reference range, and adjust a voltage level of the data voltage Vdata based on the determined result. The optical compensation device may decrease the voltage level of the data voltage Vdata when the measured luminance is higher than the target luminance. Conversely, the optical compensation device may increase the voltage level of the data voltage Vdata when the measured luminance is lower than the target luminance.

For example, when the reference grayscale Gref is 127, the target luminance of the thirteenth block BL13 may be 300 [nit], and the measured luminance may be 330 [nit]. In this case, the optical compensation device may adjust the data voltage Vdata (for example, 4 [V]) to have a voltage value corresponding to a grayscale lower than the data voltage Vdata (for example, 5 [V]) corresponding to the grayscale of 127. In this case, the optical compensation device may determine the adjusted data voltage Vdata (for example, 4 [V]) as a gamma voltage corresponding to a target luminance of 300 [nit] (or the grayscale of 127) of the thirteenth block BL13.

Conversely, when the reference grayscale is 127, the thirty-first block BL31 has a target luminance of 300 [nit], but the measured luminance may be 270 [nit]. In this case, the optical compensation device may adjust the data voltage Vdata (for example, 6 [V]) to have a voltage value corresponding to a grayscale higher than the data voltage Vdata (for example, 5 [V]) corresponding to the grayscale of 127. In this case, the optical compensation device may determine the adjusted data voltage Vdata (for example, 6 [V]) as a gamma voltage corresponding to a target luminance of 300 [nit] (or the grayscale of 127) of the thirty-first block BL31.

When the difference between the measured luminance and the target luminance is within the reference range, the optical compensation device may determine it as the gamma voltage without adjusting the data voltage Vdata. For example, when the reference grayscale is 127, the twenty-second block BL22 has a target luminance of 300 [nit], and the measured luminance may also be 300 [nit]. In this case, the optical compensation device may determine the data voltage Vdata (for example, 5 [V]) corresponding to the grayscale of 127 as the gamma voltage.

Referring to FIG. 7B, a (2_2)-th lookup table LUT2_2 may be created by using the grayscale-voltage graphs (that is, the 11th curved line CURVE11, the 21st curved line CURVE21, and the 31st curved line CURVE31) illustrated in FIG. 7A. That is, the (2_2)-th lookup table LUT2_2 may include a plurality of grayscales GR after gamma correction and information on the data voltages Vdata (or gamma voltage) for each block BL correspondingly. In this case, during the gamma correction, only data voltages Vdata for each block BL corresponding to the reference grayscale Gref are obtained, but through interpolation, the data voltages Vdata for each block BL corresponding to the grayscales GR between the reference grayscales Gref may be obtained.

Next, the grayscale-current graph of FIG. 8A (or the second lookup table LUT2 of FIG. 8B) showing the input current Iin for each position of the display panel 100 corresponding to the input grayscale IGR may be calculated by using the grayscale-voltage graph of FIG. 7A (or the (2_2)-th lookup table LUT2_2 of FIG. 7B) and the representative voltage-current characteristic graph of FIG. 6A (or the (2_1)-th lookup table LUT2_1 of FIG. 6B).

Referring to FIG. 8A, a twelfth curved line CURVE12 shows a characteristic of the input current Iin of the thirty-first block BL31 according to the grayscale GR. Since the twelfth curved line CURVE12 of FIG. 8A relates to the thirty-first block BL31, it corresponds to the eleventh curved line CURVE 11 of FIG. 7A. That is, the eleventh curved line CURVE 11 of FIG. 7A has the data voltage Vdata of 6 [V] to the grayscale of 127, and the first curved line CURVE1 of FIG. 6A has the driving current Ids of 120 [mA] to the data voltage Vdata of 6 [V], so that the twelfth curved line CURVE12 of FIG. 8A may be predicted to have the input current Iin of 120 [mA] to the grayscale of 127.

The twenty-second curved line CURVE22 shows the characteristics of the input current Iin of the twenty-second block BL22 according to the grayscale GR. Since the twenty-second curved line CURVE22 of FIG. 8A relates to the twenty-second block BL22, in a similar manner to the twenty-second curved line CURVE12, the twenty-second curved line CURVE22 of FIG. 8A may be predicted to have the input current Iin of 100 [mA] to the grayscale of 127.

The thirty-second curved line CURVE32 shows the characteristics of the input current Iin of the thirteenth block BL13 according to the grayscale GR. Since the thirty-second curved line CURVE32 of FIG. 8A relates to the thirteenth block BL13, in a similar manner to the twenty-second curved line CURVE12, the thirty-second curved line CURVE32 of FIG. 8A may be predicted to have the input current Iin of 80 [mA] to the grayscale of 127.

Referring to FIG. 8B, the second lookup table LUT2 may be created by using the grayscale-current graphs (that is, the 12th curved line CURVE12, the 22nd curved line CURVE22, and the 32nd curved line CURVE32) illustrated in FIG. 8A. That is, the second lookup table LUT2 may include information on the plurality of grayscales GR and the input current (Iin) for each corresponding block BL after gamma correction.

Next, as a third step, the input current Iin for each position of the display panel 100 corresponding to the input grayscale IGR[n] (or the compensation grayscale CGR[n]) after optical compensation may be calculated. Even after gamma correction, a spot displaying abnormal luminance may occur on the display panel 100. For example, the spot may have a bright luminance or a dark luminance compared to a peripheral area. Therefore, it is necessary to reduce a luminance deviation through optical compensation (or spot compensation).

Since the gamma correction is performed for each block BL, a luminance difference may still occur in an area smaller than the blocks BL, for example, between the pixels PX. In order to compensate for this luminance difference (or spot), the display device 1 according to the embodiment may measure the luminance of the display panel 100 in units in pixels PX unit by using an optical compensation device. The luminance measuring part used in the optical compensation process may have higher performance (for example, higher resolution) than that of the luminance measuring part used in the gamma correction process so as that the optical compensation device calculates luminance values in units of pixels PX, but is not limited thereto. For example, one luminance measuring part may be used in a gamma compensating process and a gamma correcting process.

Referring to FIG. 1, FIG. 2A, FIG. 9A, and FIG. 9B, when a luminance deviation (or spot) occurs in a specific area of the display panel 100, the optical compensation device may reduce the luminance deviation by adjusting the same inputted grayscale GR for each pixel PX included in the corresponding area (that is, increasing or decreasing the grayscale value (+/−ΔG)). For example, when a luminance deviation (or spot) occurs between the first to fourth pixels PX1, PX2, PX3, and PX4 included in the 31st block BL31, the optical compensation device may adjust, based on the second pixel PX2 displayed with a luminance corresponding to the grayscale of 127, the first pixel PX1 displayed with a luminance brighter than the luminance corresponding to the grayscale of 127 to the grayscale of 115 (or spot compensating grayscale) that is lower than the grayscale of 127, and may respectively adjust the third pixel PX3 and the fourth pixel PX4 displayed with a luminance darker than the luminance corresponding to the grayscale of 127 to the grayscale of 130 (or spot compensating grayscale) and the grayscale of 129 (or spot compensating grayscale) that are brighter than the grayscale of 127.

For example, the input current Iin corresponding to the adjusted grayscale (or spot compensating grayscale) may be calculated by using a thirteenth curved line CURV13 shown in FIG. 9A. In this case, since the twelfth curved line CURV12 of FIG. 8A corresponds to the thirty-first block BL31 of FIG. 2A, the thirteenth curved line CURV13 of FIG. 9A corresponding to the thirty-first block BL31 may be the same curved line as the twelfth curved line CURV12 of FIG. 8A. Accordingly, the input currents respectively flowing through the first to fourth pixels PX1, PX2, PX3, and PX4 may be adjusted to 116 [mA], 120 [mA], 128 [mA], and 124 [mA].

Referring to FIG. 9B, a third lookup table LUT3 may be created by using the grayscale-current graph (that is, the thirteenth curved line CURVE13) shown in FIG. 9A. That is, the third lookup table LUT3 may include information on spot compensating grayscales and corresponding input current Iin for each specific area (for example, the pixel PX) after optical compensation (or spot compensation). In this case, for better understanding and ease of description, the third lookup table LUT3 shown in FIG. 9B will be described on the assumption that a spot occurs in the thirty-first block BL31 shown in FIG. 2A when the grayscale is 127. However, the third lookup table LUT3 is not limited thereto, and when the spot compensation is performed for each grayscale (for example, grayscales of 0 to 255), a lookup table may be additionally generated for each grayscale. In addition, when the spot compensation is performed in a plurality of areas even for the same reference grayscale, a lookup table for each position may be additionally generated in response thereto.

As such, since the grayscale-current converter 230 includes the second lookup table LUT2 and the third lookup table LUT3 generated through the gamma correction and/or the optical compensation (or spot compensation) performed before product shipment, it is possible to calculate the input current Iin corresponding to the input grayscale IGR[n] inputted to the deterioration information generator 210 without actually measuring it.

Referring back to FIG. 5, the deterioration information generator 210 calculates deterioration data corresponding to the pixel PX (or the block BL) for each pixel PX (or block BL) based on the deterioration weight, and adds the calculated deterioration data (or block deterioration data) to the existing lifetime value AGE (or block lifetime value), thereby updating the lifetime value AGE (or block lifetime value). For example, the deterioration information generator 210 may receive, from the memory 10, the first lifetime value AGE[n−1] information in which the deterioration data respectively corresponding to the first frame to the (n−1)-th frame is accumulated. The deterioration information generator 210 may calculate the second lifetime value AGE[n] by further accumulating deterioration data corresponding to the n-th frame in the first lifetime value AGE[n−1]. The calculated second lifetime value AGE[n] may be stored back in the memory 10.

The deterioration information generator 210 may calculate the deterioration data by multiplying, in units of the pixel PX (or the block BL), the grayscale acceleration value corresponding to the input grayscale IGR[n], the temperature acceleration value according to the internal temperature of the display device 1, and the deterioration weight. Specifically, the second lifetime value AGE[n] may be calculated by the equation below.

$$\mathrm{AGE}[n]=\mathrm{AGE}[n-1]+GRV[n]*WP*TP$$

(Here, AGE[n−1] is a lifetime value up to the (n−1)-th image frame, GRV[n] is a grayscale acceleration value in the n-th image frame, TP is a temperature acceleration value corresponding to the temperature data TD for each pixel PX (or block) provided from the temperature sensor 20, WP is a deterioration weight value, and AGE[n] is a lifetime value up to the n-th image frame.)

In this case, the grayscale acceleration value may be calculated by the equation below.

$$GRV[n]=(G_i/G_{max})^{\beta\gamma}$$

(Here, GRV[n] is a grayscale acceleration value in the n-th image frame, Gi is an input grayscale, Gmax is a maximum grayscale, β is a luminance acceleration coefficient, and γ is a gamma value.)

The luminance acceleration coefficient and the gamma value may be pre-stored in the memory 10 before product shipment, and may be actively re-defined during product use. For example, the maximum grayscale may be 255, β may be 1.8 to 2, and γ may be 2.2.)

$$Wp=(I_{in}/I_{ref})^{\alpha}$$

In Equation 2, GRV[n] *WP*TP may be deterioration data. That is, as the grayscale acceleration value (for example, GRV[n]) increases in the n-th image frame, the deterioration weight value (for example, WP) increases, and the temperature acceleration value (for example, TP) increases, the deterioration data may increase in the n-th image frame. As deterioration data (for example, GRV[n] *WP*TP) increases, the lifetime value (for example, ACE [n]) may increase.

The compensator 220 may receive the input grayscale IGR[n] and the first lifetime value AGE[n−1], and may calculate the compensation grayscale CGR[n]. The compensator 220 may include the first lookup table LUT1 of FIG. 4. The compensator 220 may calculate the compensation grayscale CGR[n] by referring to the input grayscale IGR[n] and the first lifetime value AGE[n−1] provided from the memory 10, and the compensation grayscale CGR[n] may be determined by using the first lookup table LUT1 as described with reference to FIG. 4.

The output part 240 may generate the compensation data ACDATA by applying the compensation grayscale CGR[n] to the input image data IDATA to output the compensation data ACDATA to the data driver 400.

According to the display device 1 (see FIG. 1) of an embodiment by assigning a weight according to the input current Iin for each position of the display panel 100 by using a grayscale-current relationship obtained through gamma correction and optical compensation, it is possible to more precisely perform afterimage compensation. In this case, without actually measuring the input current Iin, it is calculated through an algorithm (or a lookup table generated by using the algorithm), so that the lifetime value AGE may be more quickly calculated.

Although certain embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A display device comprising:

a display panel that includes a plurality of pixels;

a deterioration compensator that is configured to output compensation data based on a lifetime value of the plurality of pixels and an input grayscale of input image data;

a scan driver that is configured to supply a scan signal to the display panel; and a data driver that is configured to supply a data signal corresponding to the compensation data to the display panel, wherein the deterioration compensator includes a grayscale-current converter that calculates an input current corresponding to the input grayscale, wherein the deterioration compensator includes a deterioration information generator that is configured to calculate a deterioration weight value for each position of the plurality of pixels based on the input current and a preset reference current, and that is configured to update the lifetime value by accumulating deterioration data reflecting the deterioration weight value, wherein the deterioration weight value is calculated by a ratio of the input current to the reference current.

2. The display device of claim 1, wherein the deterioration weight value is calculated by the equation below $$Wp=(I_{in}/I_{ref})^{\alpha},$$

wherein Wp is a deterioration weight value, Iref is a reference current, Iin is an input current, and α is a current acceleration coefficient.

3. The display device of claim 1, wherein the deterioration compensator includes a compensator that is configured to calculate a compensation grayscale by using the input grayscale and the lifetime value.

4. The display device of claim 3, wherein:

the compensator includes a first lookup table in which a plurality of lifetime values and compensation grayscales respectively corresponding to grayscales that are able to be implemented by the display panel are set; and the compensation grayscale is determined by a value that is mapped to the input grayscale and the lifetime value in the first lookup table.

5. The display device of claim 4, wherein:

the grayscale-current converter includes a second lookup table in which the compensation grayscales and input currents corresponding to respective blocks partitioned in the display panel are set after gamma correction; and the input current is determined by a value that is mapped to the compensation grayscale and the blocks in the second lookup table.

6. The display device of claim 4, wherein:

the grayscale-current converter includes a second lookup table in which the compensation grayscales and input currents corresponding to respective blocks partitioned in the display panel are set after gamma correction; and a third lookup table in which the compensation grayscales and input currents corresponding to respective ones of the plurality of pixels in which a spot occurs are set after spot compensation, and the input current is determined by a value which is mapped to the compensation grayscale and the blocks in the third lookup table.

7. The display device of claim 4, wherein the deterioration compensator further includes an output part that is configured to generate the compensation data by applying the compensation grayscale to the input image data.

8. The display device of claim 1, wherein the plurality of pixels are grouped into a plurality of blocks, and a number of the blocks is smaller than or equal to a number of the plurality of pixels.

9. The display device of claim 1, further comprising a temperature sensor that is configured to measure an ambient temperature of the display panel.

10. The display device of claim 9, wherein the deterioration information generator accumulates the deterioration data by reflecting input grayscales for the pixels and a temperature acceleration value corresponding to the ambient temperature to the deterioration data.

11. The display device of claim 10, wherein the deterioration information generator calculates the deterioration data by multiplying a grayscale acceleration value corresponding to the input grayscale, the temperature acceleration value, and the deterioration weight value.

12. The display device of claim 11, wherein the deterioration information generator accumulates the deterioration data by further reflecting a grayscale acceleration value of a current image frame calculated by the equation below to the deterioration data $$GRV[n]=(G_i/G_{max})^{\beta\gamma},$$

wherein GRV[n] is a grayscale acceleration value in the current image frame, Gi is an input grayscale, Gmax is a maximum grayscale, β is a luminance acceleration coefficient, and γ is a gamma value.

13. The display device of claim 1, further comprising a memory that stores the lifetime value.

14. A display device comprising:

a display panel that includes a plurality of pixels;

a deterioration compensator that is configured to output compensation data based on a lifetime value of the plurality of pixels and an input grayscale of input image data;

a scan driver that is configured to supply a scan signal to the display panel; and a data driver that is configured to supply a data signal corresponding to the compensation data to the display panel, wherein the deterioration compensator includes a grayscale-current converter that calculates an input current corresponding to the input grayscale, wherein the deterioration compensator includes a deterioration information generator that is configured to calculate a deterioration weight value for each position of the plurality of pixels based on the input current and a preset reference current, and that is configured to update the lifetime value by accumulating deterioration data reflecting the deterioration weight value, wherein the deterioration compensator includes a compensator that is configured to calculate a compensation grayscale by using the input grayscale and the lifetime value, wherein the compensator includes a first lookup table in which a plurality of lifetime values and compensation grayscales respectively corresponding to grayscales that are able to be implemented by the display panel are set, wherein the compensation grayscale is determined by a value that is mapped to the input grayscale and the lifetime value in the first lookup table, and wherein the second lookup table is calculated by using a (2_1)-th lookup table that includes information on a plurality of test voltages and corresponding driving currents measured in one reference pixel among the plurality of pixels after external compensation; and a (2_2)-th lookup table that includes information on a plurality of grayscales and corresponding data voltages for each block after the gamma correction.

15. A display device comprising:

a display panel that includes a plurality of pixels;

a deterioration compensator that is configured to output compensation data based on a lifetime value of the plurality of pixels and an input grayscale of input image data; and a data driver that is configured to supply a data signal corresponding to the compensation data to the display panel, wherein the deterioration compensator includes a grayscale-current converter that calculates an input current corresponding to the input grayscale, wherein the plurality of pixels are grouped into a plurality of blocks, and a number of the blocks is smaller than or equal to a number of the plurality of pixels, wherein the deterioration compensator includes a deterioration information generator that is configured to calculate a deterioration weight value for each position of the plurality of pixels based on the input current and a preset reference current, and that is configured to update the lifetime value by accumulating deterioration data reflecting the deterioration weight value, wherein the deterioration weight value is calculated by the based on a ratio of the input current to the reference current.

16. The display device of claim 15, wherein the deterioration compensator includes a compensator that is configured to calculate a compensation grayscale by using the input grayscale and the lifetime value.

17. The display device of claim 16, wherein:

the compensator includes a first lookup table in which a plurality of lifetime values and compensation grayscales respectively corresponding to grayscales that are able to be implemented by the display panel are set; and the compensation grayscale is determined by a value that is mapped to the input grayscale and the lifetime value in the first lookup table.

18. The display device of claim 15, wherein the deterioration weight value is calculated by the equation below $$Wp=(I_{in}/I_{ref})^{\alpha},$$

wherein Wp is a deterioration weight value, Iref is a reference current, Iin is an input current, and a is a current acceleration coefficient.

* * * * *